US010674849B2

(12) United States Patent
Iliev

(10) Patent No.: US 10,674,849 B2
(45) Date of Patent: Jun. 9, 2020

(54) MECHANICAL UTENSIL

(71) Applicant: Ivaylo Iliev, Sofia (BG)

(72) Inventor: Ivaylo Iliev, Sofia (BG)

( * ) Notice: Subject to any disclaimer, the term of this patent is extended or adjusted under 35 U.S.C. 154(b) by 0 days.

(21) Appl. No.: 16/029,519

(22) Filed: Jul. 6, 2018

(65) Prior Publication Data

US 2018/0310741 A1 Nov. 1, 2018

Related U.S. Application Data

(63) Continuation-in-part of application No. 14/905,958, filed as application No. PCT/BG2014/000028 on Jul. 15, 2014, now Pat. No. 10,016,081.

(30) Foreign Application Priority Data

Jul. 18, 2013 (BG) ..... 002589

(51) Int. Cl.
*A47G 21/08* (2006.01)
*A47G 21/02* (2006.01)

(52) U.S. Cl.
CPC ..... *A47G 21/08* (2013.01); *A47G 21/02* (2013.01); *A47G 21/023* (2013.01)

(58) Field of Classification Search
CPC ..... A47G 21/08; A47G 21/023; A47G 21/02
USPC ..... 30/148
See application file for complete search history.

(56) References Cited

U.S. PATENT DOCUMENTS 57,918 A * 9/1866 Jennings
331,117 A 11/1885 Albin ..... A47G 21/08 30/148
843,953 A 2/1907 Laramy ..... A47G 21/02 30/147
1,294,031 A 2/1919 Bigelow ..... A47G 21/08 30/148
1,324,565 A * 12/1919 Przybylek ..... A47G 21/08 30/148
1,553,006 A 9/1925 Sallac ..... 30/148
1,585,533 A * 5/1926 Coursen ..... A47G 21/06 30/148
2,322,503 A 6/1943 Bowman ..... 30/148
2,473,288 A 6/1949 McNeill ..... A47G 21/02 30/147
3,376,640 A * 4/1968 Kramer ..... A47G 21/08 30/148

(Continued)

FOREIGN PATENT DOCUMENTS

DE 10 2006 059 268 A1 * 6/2008
DE 10-2006-059268 A1 6/2008

(Continued)

OTHER PUBLICATIONS

English tranlation of DE 10 2006 059 268 A1 (Publication Date: Jun. 2008).*

*Primary Examiner* — Hwei-Siu C Payer
(74) *Attorney, Agent, or Firm* — Steven M. War, Esq.

(57) ABSTRACT

The invention relates to a mechanical eating utensil which combines the capabilities of a fork, characterized by function for spearing the food and of a knife characterized by function for cutting the food and can be used by handicapped and people with decreased functional ability of one of their upper limbs. The eating utensil consists of a handle and an instrument end with one or more rotating cutting tines.

1 Claim, 7 Drawing Sheets

(56) References Cited

U.S. PATENT DOCUMENTS

| | | | | | |
|---|---|---|---|---|---|
| 3,771,224 | A * | 11/1973 | Bono, Jr. | A47G 21/02 | 30/148 |
| 4,182,032 | A | 1/1980 | Newport | 30/137 | |
| 4,535,538 | A | 8/1985 | Nelson | A47G 21/02 | 30/147 |
| 4,984,367 | A | 1/1991 | Albanese | A47G 21/02 | 30/147 |
| 5,542,181 | A | 8/1996 | Gaylord | A47G 21/02 | 30/148 |
| 9,265,372 | B2 | 2/2016 | Stewart-Stand | A47G 21/02 | |
| 10,016,081 | B2 * | 7/2018 | Iliev | A47G 21/08 | |
| 2016/0113425 | A1 * | 4/2016 | Olival | A47G 21/08 | 30/148 |
| 2016/0166095 | A1 * | 6/2016 | Iliev | A47G 21/023 | 30/148 |

FOREIGN PATENT DOCUMENTS

| | | | |
|---|---|---|---|
| FR | 524 805 A | | 9/1921 |
| FR | 2 466 228 | * | 4/1981 |
| GB | 109739 | * | 9/1917 |
| GB | 116611 | * | 6/1918 |
| GB | 130902 | * | 8/1919 |
| GB | 144145 | * | 6/1920 |
| WO | WO 79/00270 | * | 5/1979 |

* cited by examiner

MECHANICAL UTENSIL

CROSS REFERENCE TO RELATED APPLICATION

The current application is a continuation-in-part application of U.S. application Ser. No. 14/905,958 now U.S. Pat. No. 10,016,081 filed on Jan. 18, 2016 which claims priority to, and is a national stage application of, PCT/BG2014/000028 which was filed on Jul. 15, 2014 which claims priority to Bulgarian Patent Application No. 002589 which was filed on Jul. 18, 2013.

FIELD OF THE INVENTION

The invention relates to a mechanical utensil.

SUMMARY OF THE INVENTION

A mechanical eating utensil comprising a handle including a mechanism and a drive surface for the user to operate the mechanism of the mechanical eating utensil, an instrument end including at least one kinematic tine wherein the kinematic tine includes at least one cutting edge, single-handed means for the user to hold and control the functional characteristics of the mechanical eating utensil and by means of the drive surface to operate the mechanism which disposes the cutting edge of the kinematic tine of the mechanical eating utensil from a protected position to an exposed position and vice versa. An eating utensil that includes a mechanism operable with one hand, that, when subjected to a mechanical or electromagnetic force, causes an internal and external displacement of one or more parts of the eating utensil thereby permitting the eating utensil to have dual functional characteristics, namely: spearing and cutting of food. An individual utensil that by means of an inbuilt mechanics (including a mechanism, a transmission and kinematic parts with constrained motion) implements the functional characteristics of the eating fork and the eating knife.

BACKGROUND

The well-known eating utensil (fork) includes a handle and an instrument end with shaped static tines for spearing or scooping food. The number of these static tines is usually 2, 3 or 4. The two endmost tines are rounded on their outer sides so when positioning the utensil laterally, even after applying significant efforts the soft food is torn to pieces but hardly cut precisely. Due to this, another utensil is needed—generally a knife—for cutting food into pieces. Use of these two utensils (the knife and the fork) simultaneously, requires the use of both hands for eating the food. For this reason the separate knife and fork are of little use to handicapped people and to people with decreased functional who are not able to simultaneously use both a knife and a fork.

DESCRIPTION OF THE DRAWINGS

In the drawings, like reference characters generally refer to the same parts throughout the different views. The drawings are not necessarily to scale, rather emphasis is generally being placed upon illustrating the principles of various embodiments of the invention. The foregoing and other aspects of the invention will be better understood from the following description of embodiments of the invention, by way of example only, and with reference to the accompanying drawings, in which.

DETAILED DECSCRIPTION OF THE INVENTION

Figure 1:
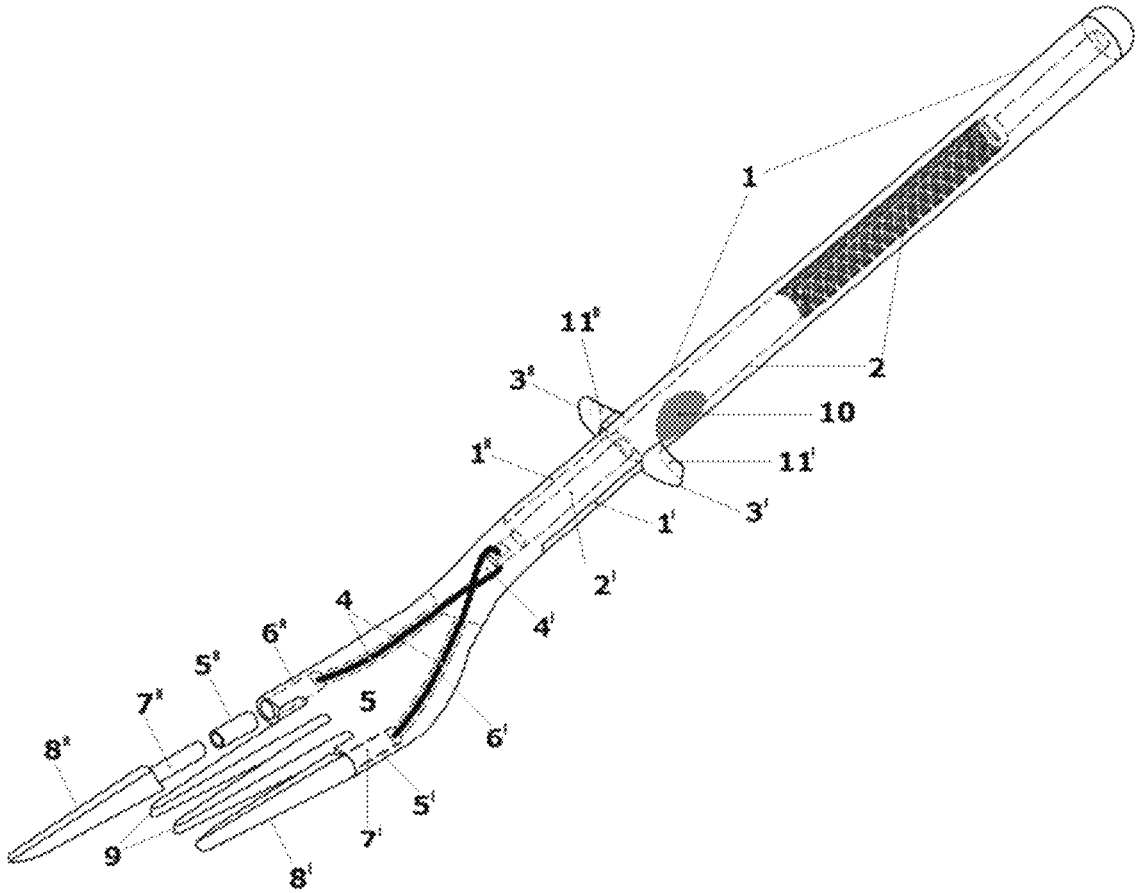
FIG. 1 shows an axonometric view of the eating utensil of one embodiment of the current invention which includes two static tines.

In the following detailed description, reference will be made in detail to the preferred embodiments of the present invention, examples of which are illustrated in the accompanying drawings, which form a part hereof and show by way of illustration embodiments in which the invention may be practiced. These embodiments are described in sufficient detail to enable those skilled in the art to practice the invention, and it is to be understood that other embodiments may be utilized, and that structural, and logical changes may be made without departing from the spirit and scope of the present invention. The progression of processing steps described is exemplary of embodiments of the invention; however, the sequence of steps is not limited to that set forth herein and may be changed as is known in the art, with the exception of steps necessarily occurring in a certain order.

The major objective of the invention is to develop a mechanical eating utensil which may be used with one a single hand and will perform the functions of both a fork and a knife and can be adapted for use by the disabled and by people with decreased functional ability of one of their upper limbs or by people who prefer to eat with only one hand.

The objective is solved with the creation of a mechanical eating utensil which includes a handle with a mechanism and an instrument end, and which may include one or more middle static tines. At least one of the two endmost tines can be rotated such that its inner side is rotated outwards. The inside side of the one or more rotatable endmost tines (or kinematic tines) includes an inner section which includes a blade for cutting food.

In one embodiment, the cavity of the handle includes a built-in reciprocating spring mechanism which can be operated by the user to rotate the endmost tine such that the portion of the endmost tine that normally faces inward faces outward. In this embodiment, the outer circumferential surface of the handle includes slots with mounted sliders which include pushing surfaces of the reciprocating spring mechanism. The rotating part of the mechanism inside the handle is connected to a transmission, built into the handle and instrument end of the eating utensil. In some embodiments the transmission consists of a monolith flexible shaft, bent in the middle making a turn and twisted at 90 degrees relative to the bending plane, thus forming a loop which is placed into handle's neck and two active ends placed into holes made all along the instrument end. The holes at the frontal side of the instrument end may contain bearing shafts, connected to the active ends of the flexible shaft. The bearing shaft (or shafts) hold the cutting tine(s), which can rotate bi-directionally to 180 degrees. The inner longitudinal sides of these tines are shaped as blade for cutting food.

When the utensil is not in use, the sharpened sides of cutting tines (or kinematic tines), are turned to the middle static tines. It is possible for the cutting tines to be fixed to the root of the instrument end via bearing shafts in addition with wedging bushings.

The eating utensil combines the capabilities of a fork, characterized by function for spearing food and of a knife characterized by function for cutting the food. This makes it usable by people with disabilities and with a decreased functional ability of one of their upper limbs. Thanks to the ergonomic shape of the handle and the two side sliders, the mechanical eating utensil can be used by both the left and the right hand.

As shown in FIG. 1, the mechanical eating utensil consists of a handle (1) and an instrument end (5) where the instrument end contains at least one cutting tine (8' or 8") (or kinematic tine) which includes a cutting edge on one side of the cutting tine and the cutting edge of the cutting tine is normally orientated towards the longitudinal center of the utensil. The mechanical eating utensil also includes a mechanism for transitioning the cutting edge of the cutting tine from being orientated towards the longitudinal center of the mechanical eating utensil to the outside of the utensil and, in that position, the cutting edge is available to cut food. As shown in FIG. 1, the utensil can include one or more middle static tines (9). One of ordinary skill in the art would understand that middle static tines are not needed (or necessary) to practice the current invention. In one embodiment, the handle (1) has a cavity in which a semi-automatic reciprocating spring mechanism (2) is positioned. In this embodiment, the outer circumferential surface of the handle (1) includes slots (1') and (1") with ergonomically shaped sliders (3', 3") placed in them, for use with either the right or the left hand. When the utensil is positioned laterally for cutting food the place of the slider (3', 3") coincides with the abutment surface (10) for the index finger of the user over the handle (1). The abutment surface (10) is positioned at the location that is used by the user's pointing finger to apply a force over the utensil (typically the portion of the finger one uses to cut food with an ordinary fork). In this position, the finger applies a force on the utensil, during the act of cutting. Any other disposition of the finger over the handle is ergonomically unnatural and physically inappropriate for applying the necessary force in the act of cutting (with a fork).

Slider (3', 3") includes a pushing surface (11', 11") of the reciprocating spring mechanism (2) which takes the pressure force from the user's index finger and inputs it as translational motion into the mechanism (2). Because of its specific construction, the mechanism (2) transforms the translational motion into a rotational motion, with increased moment of force according to the relation ratio between acceleration of the translational momentum and momentum of force of the rotational movement. The rotating part (2') of the mechanism (2) inside the handle (1) is connected to a transmission (4), built into the handle (1) and holes (6') and (6") included in the instrument end (5) of the utensil. Preferably, the rotating part (axis) (2') is a unit part of the semi-automatic reciprocating spring mechanism (2).

The transmission (4) may consist of a monolith flexible shaft, bent in the middle, thus forming a loop (4') inside handle's neck. Generated rotational movement from the mechanism (2) is projected over the loop (4'). The difference between the radius of the loop (4') and the radius of the flexible shaft (4) increases the torque of the rotational movement additionally. The rotational movement of the loop (4') at 180 degrees is transmitted without any losses of angular velocity to the two active ends of the transmission (4), placed in holes (6') and (6"). The active ends of the transmission (4) are in a permanent connection with the bearing shafts (7') and (7") which are connected to rotating cutting tines (8') and (8") with longitudinal inner side shaped as a blade. The bearing shafts (7') and (7") are positioned in holes (6') and (6") at frontal side of the instrument end (5) via wedging bushings (5') and (5") which protects the holes (6') and (6") from fluids and ensures low friction during the rotational motion of cutting tines (8') and (8"). Wedge bushing (5' and 5") and the lower part of the transmission (4) enter the holes (6' and 6") from opposite directions and the preferably, bearing shaft (7' or 7") are connected to the end of the transmission (4) inside the wedge bushings (5' and 5").

Figure 2:
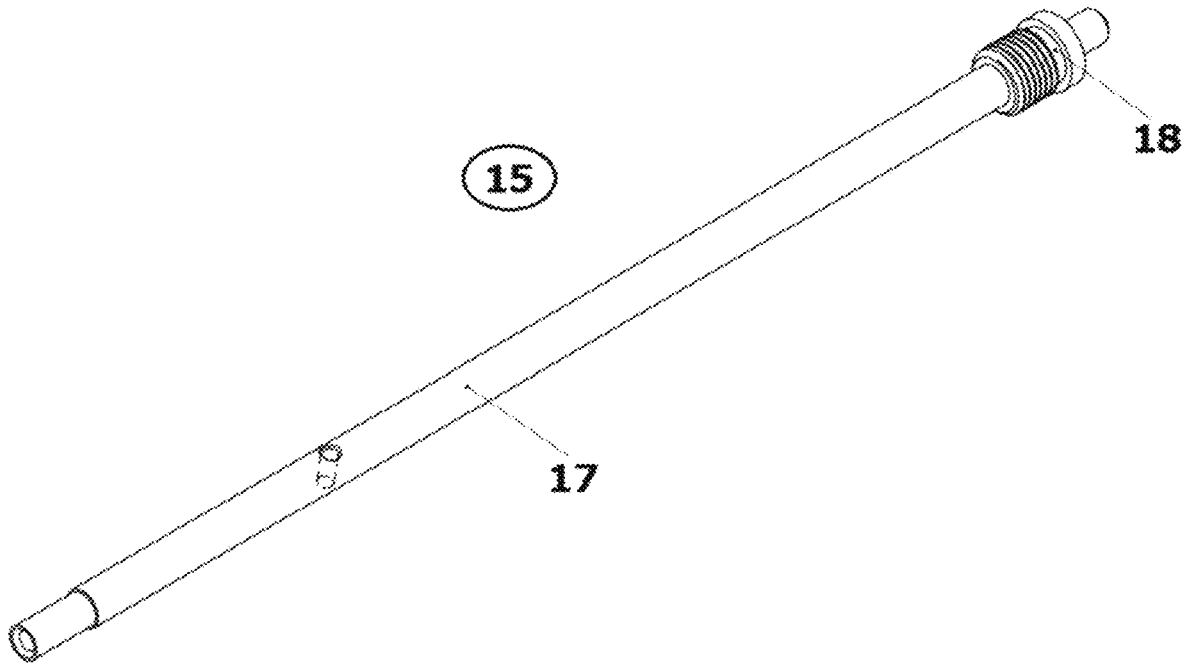
FIG. 2 shows a rotational unit of the semi-automatic reciprocating spring mechanism.
Figure 3:
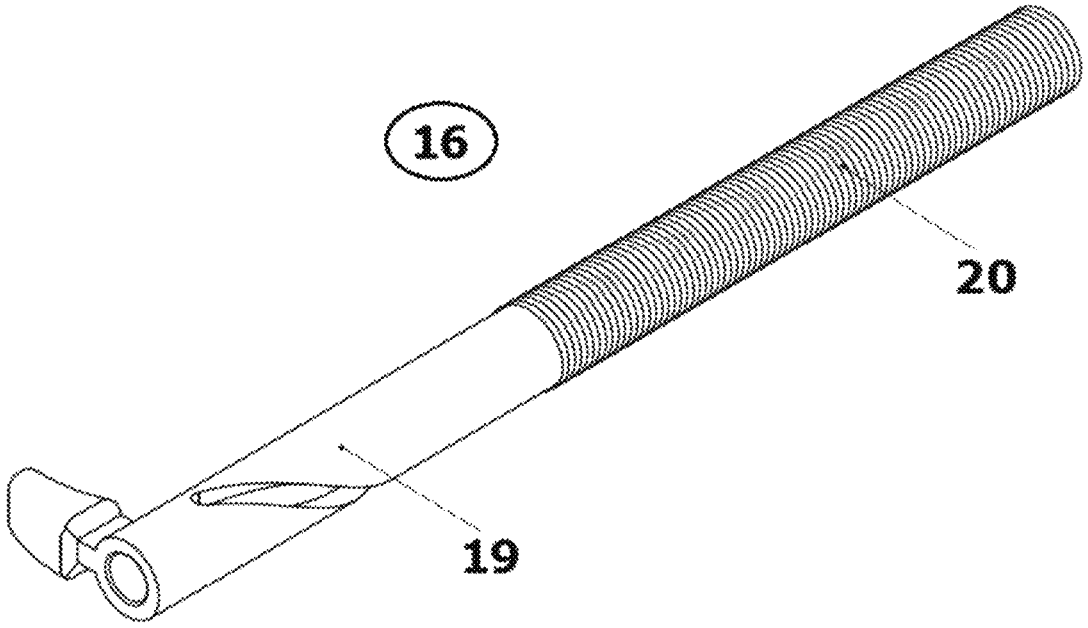
FIG. 3 shows a reciprocating (sliding unit) of the semi-automatic reciprocating spring mechanism.
Figure 4:
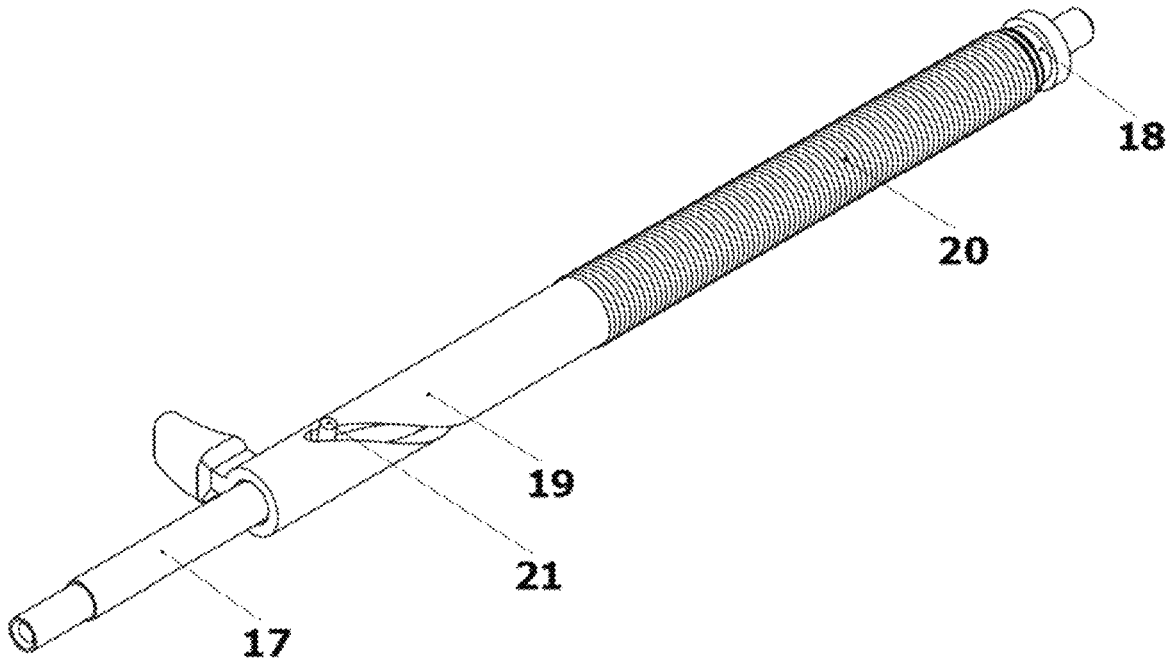
FIG. 4 shows the assembled semi-automatic reciprocating spring mechanism (the reciprocating unit connected with the rotational unit by means of a permanent mechanical joint of type helical joint)

In this embodiment, the semi-automatic reciprocating spring mechanism (2) preferably has two mechanical units, a rotational (rotary) unit (15) (FIG. 2) and a reciprocating (sliding unit) (16) (FIG. 3). The rotational (rotary unit) includes a rotational part (a long axis) (17) and a fitting part (18) (inside and outside threaded customized screw). The reciprocating (sliding unit) (16) includes a drive (sliding) part (a tube with a helical slot) (19) and a spring part (an extension spring) (20). These two mechanical units (the rotational unit [15] and the reciprocating unit [16]) may be connected by a permanent mechanical joint such as a "screw joint" or a "helical joint" (21) (FIG. 4). The helical joint (21) is responsible for the conversion of the reciprocating (translational) movement (of the reciprocating unit) to a rotational movement (of the rotational unit).

The semi-automatic reciprocating spring mechanism is (a) a semi-automatic mechanism—because the drive part is driven manually in one direction and it is driven automatically in the opposite direction; (b) a reciprocating mechanism—because the drive part is performing only reciprocating (sliding) motion and (c) a spring mechanism because a spring drives the drive part in one of the two directions of movement (sliding).

When the pushing surface (11', 11") of the slider (3', 3") is pressed (by a finger), the tube slides down along the axis. The spring is stretched, and therefore under tension. Simultaneously the helical joint (21) between the tube (19) and the axis (17) causes the axis (17) to rotate. The axis (17) forces the loop (4') to turn around which causes the two ends of the trans-mission (4) to rotate. The two rotating ends of the transmission (4) are connected to the bearing shafts (7', 7") and the rotation of the two ends of the transmission (4) causes the one or more cutting tines (or kinematic tines) (8', 8") to rotate, and the cutting edges of the cutting tines (8', 8") are exposed and available to cut food. Releasing the pressure on the pushing sur-face (11', 11") of the slider (3', 3") allows the spring (20) to relax and pull back the tube (19) which causes the cutting edges of the cutting tines (8', 8") to be pointed inward longitudinally.

The semi-automatic reciprocating spring mechanism (2) works with the rotating part to transform the translational movement to a rotational movement and to rotate/drive the rotating cutting tines. Converting translational movement to a rotational movement, is facilitated through the use of, for example, a mechanism with minimum two units: rotational unit and reciprocating unit that are connected together by a permanent mechanical joint of type "helical joint". One of ordinary skill in the art would appreciate that the arrangement used to translate movement in the mechanism is that of a helical or similar joint between its units. A reciprocating mechanism with a rotating unit/part and a helical or similar joint is used to drive/rotate the rotating cutting tines. A translational movement cannot be transformed to a rotational movement and the rotating cutting tines cannot rotate, in the arrangement disclosed, without a mechanism or without a helical or similar joint in it.

Figure 5:
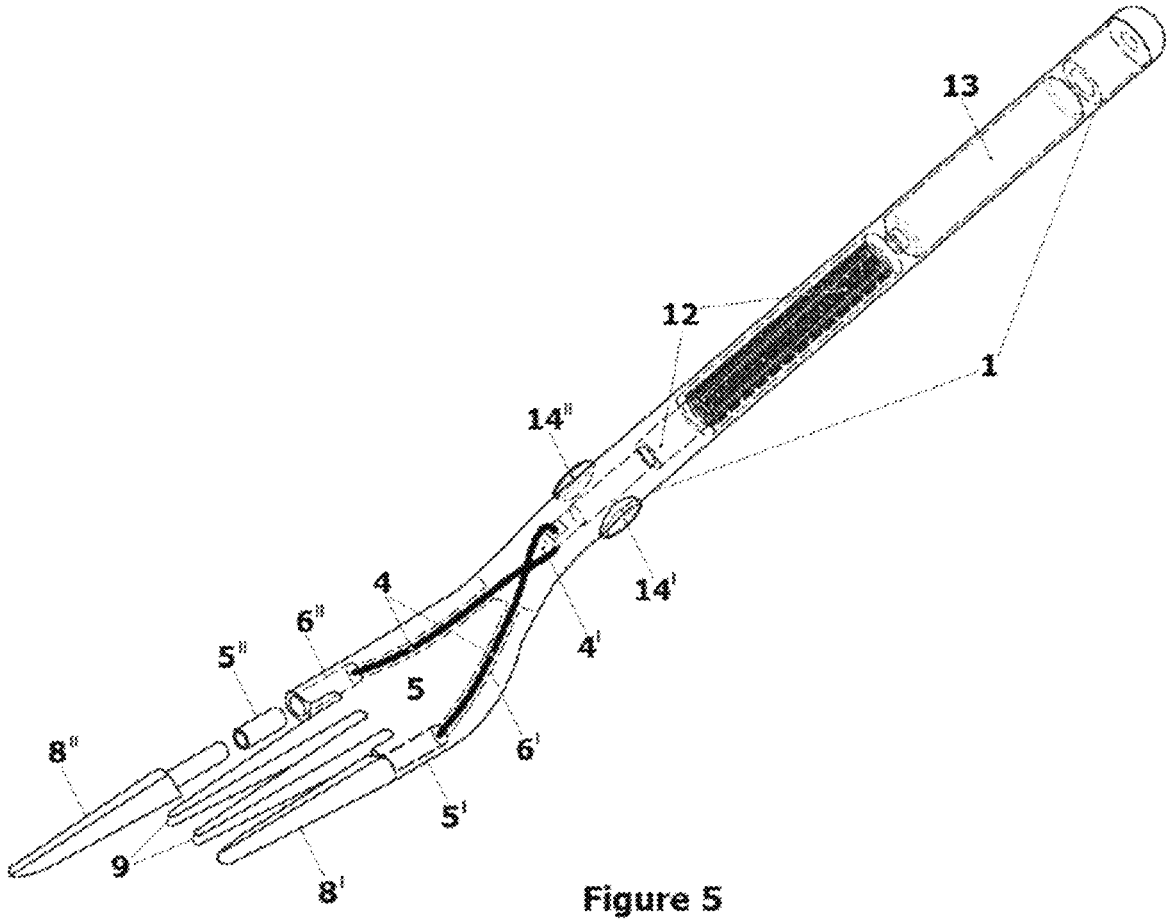
FIG. 5 shows a view of an eating utensil of a second embodiment of the current invention which includes two static tines and an electromagnetic mechanism of type linear (voice) coil actuator to deploy the cutting edge of the cutting tines.

FIG. 5 illustrates another embodiment of the current invention in which the manual mechanism for rotating one or more of the rotating cutting tines (or kinematic tines) has been replaced with an actuating means, electromagnetic mechanism, including a power source, such as a battery. The embodiment illustrated in FIG. 5 includes a handle (1) and an instrument end (5). The embodiment illustrated in FIG. 5 also includes two rotating cutting tines (8', 8"), two middle tines (9), two wedge bushings (5', 5"), a loop (4'), and a transmission (4). However, in the embodiment illustrated in FIG. 5, the ergonomically shaped sliders (3', 3") and the mechanical means of FIG. 1 to rotate the cutting tines have been replaced with an actuating means (such as buttons (14' 14")), electromagnetic mechanism (12) and power source (13) (such as a battery). The electromagnetic mechanism may be an electrical motor, a solenoid actuator, a moving (voice) coil actuator or similar devices. Again, one of ordinary skill in the art would understand that static tines are not required to practice the present invention and that some embodiments of the current invention would not include any static tines.

In the embodiment illustrated in FIG. 5, the handle (1) has a cavity that houses a battery 13 and an electromagnetic mechanism which, when energized by the battery (through a switch) causes the cutting tine to rotate exposing the cutting edge of the cutting tine thereby permit-ting the user to use the cutting edge to cut food. In this embodiment, the outer circumferential surface of the handle (1) includes energizing buttons (14' and 14") for use with right or left hand. When the utensil is positioned laterally for cutting food the place of the energizing buttons (14', 14") coincides with position on the handle that a user would place his or her index finger. When the one of the energizing buttons is depressed, the cutting edge of the cutting tine is rotated from a first positions (positioned towards the longitudinal center of the utensil) to a second position (positioned such that the cutting edge is facing the outside of the utensil).

Figure 6:
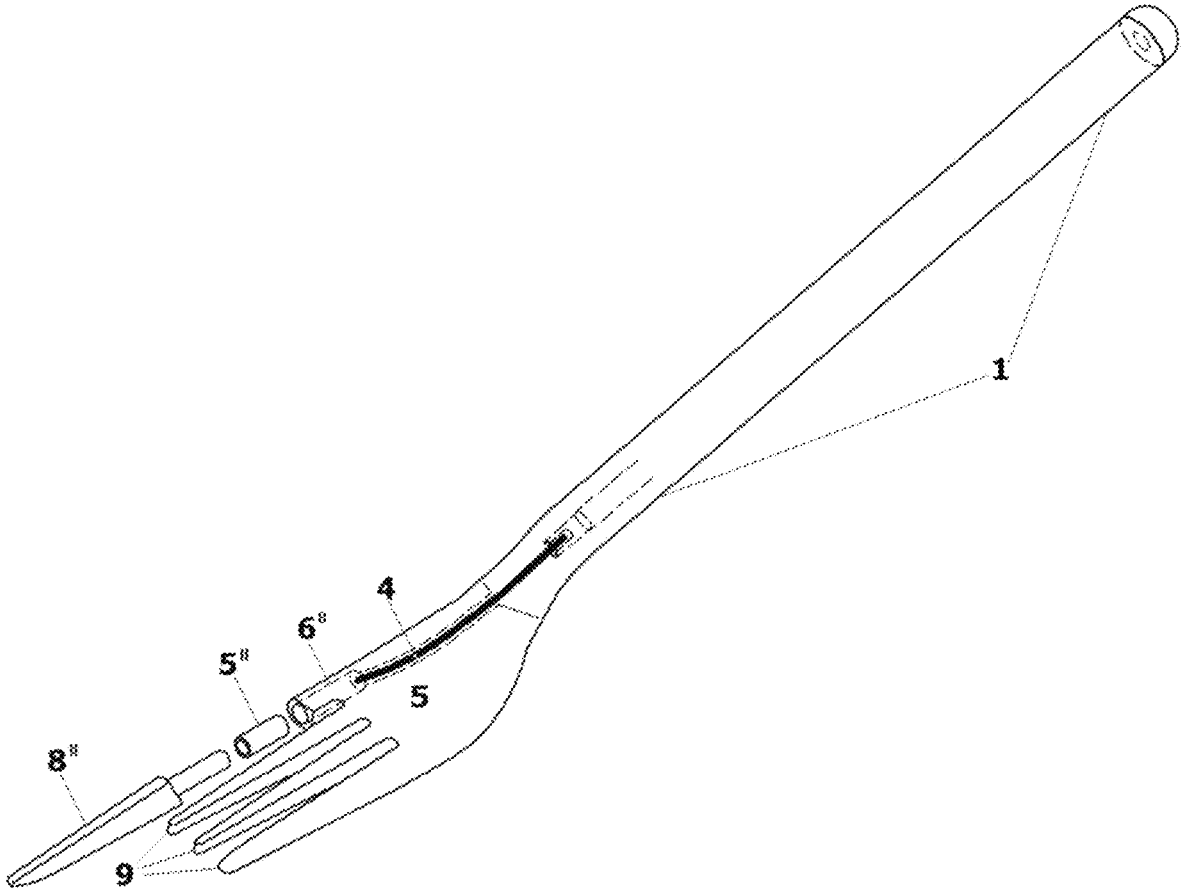
FIG. 6 shows a view of an eating utensil of a third embodiment of the current invention which includes three static tines (where one of the outside tines is a static tine) and a single rotating cutting tine.

FIG. 6 illustrates another embodiment of the current invention which includes a single rotating cutting tine (8") and one or more static tines (9). The embodiment illustrated in FIG. 6 also includes a means for rotating the rotating cutting tine (8"). One of ordinary skill in the art would appreciate that the embodiment illustrated in FIG. 6 could include the mechanical means for rotating the cutting tine (8") described with respect to FIG. 1 or the electrical mechanical means described with respect to FIG. 5. Accordingly, the means for rotating and actuating the cutting tine in this embodiment have been purposely removed from FIG. 6.

Figure 7:
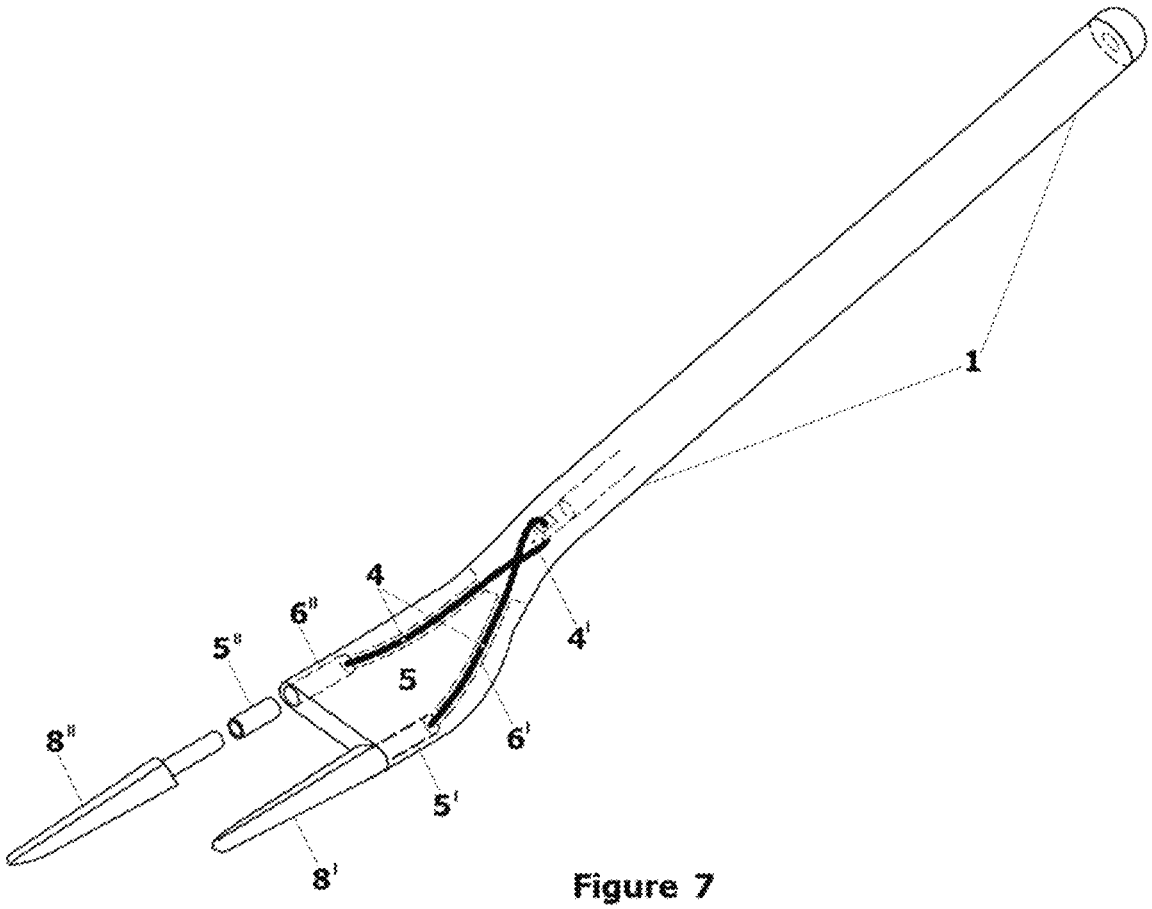
FIG. 7 shows a view of an eating utensil of a fourth embodiment of the current invention which includes two cutting tines but no static tines.

FIG. 7 shows a view of an eating utensil of a fourth embodiment of the current invention which does not include any static tines. One of ordinary skill in the art would appreciate that the embodiment illustrated in FIG. 7 could include the mechanical means for rotating the cutting tine (8") described with respect to FIG. 1 or the electrical mechanical means described with respect to FIG. 5. Accordingly, the means for rotating and actuating the cutting tine in this embodiment have been purposely removed from FIG. 7.

Application of the Invention

When the utensil is positioned laterally for cutting up of food, position of the user's index finger coincides with one of the sliders (3') or (3") (in the mechanical embodiments) or the buttons (14', 14") depending on whether left or right hand is used. In the mechanical embodiments, the pressure force of the finger in the attempt to cut food causes the slider (3') or (3") to move down along axis of the handle (1) and triggers the reciprocating spring mechanism (2) which transforms the translational motion of the slider (3') or (3") into a rotational one. The rotational movement from mechanism (2) is transmitted via the flexible transmission (4) to the bearing shafts (7') and (7") which cause the cutting tines (8') and (8") to rotate to 180 degree. To guarantee safety, when the utensil is positioned for spearing or lifting food, the mechanism (2) could not be triggered and the cutting edges of the rotating cutting tines (8') and (8") are directed internally towards the middle static tines (9) on the instrument end (5) of the utensil. When turning their cutting profiles to the outer side of the utensil they stay in this position until the cutting is over. After cutting the food, and after the pressure force of the user's index finger from the slider (3') or (3") is released, the reciprocating spring mechanism (2) returns the cutting tines (8') and (8") to its initial safe position (with blades directed internally), thus insuring the safe use of the utensil by the user.

While the invention has been particularly shown with reference to specific embodiments, it should be understood by those of ordinary skill in the art that various changes in form and detail may be made therein without departing from the spirit and scope of the invention as defined by the claims. The invention is to cover all modifications, equivalents, and alternatives falling within the spirit and scope of the invention as defined by the claims.

The invention claimed is:

1. A mechanical eating utensil comprising:

a handle including a semi-automatic mechanism and a pushing surface for a user to operate said semi-automatic mechanism of said mechanical eating utensil;

an instrument end including at least one kinematic tine wherein said kinematic tine includes at least one cutting edge;

said handle including said semi-automatic mechanism providing a means for said user to hold and control with only one hand (left or right) functional characteristics of said mechanical eating utensil and by means of said pushing surface to operate the semi-automatic mechanism which disposes said cutting edge of said kinematic tine of said mechanical eating utensil from a protected position to an exposed position and vice versa.

* * * * *